US009022600B2

(12) United States Patent
Mizuta et al.

(10) Patent No.: US 9,022,600 B2
(45) Date of Patent: May 5, 2015

(54) LED ILLUMINATION DEVICE

(75) Inventors: Kohei Mizuta, Kyoto (JP); Akio Yabugami, Kyoto (JP); Hiroaki Tsujii, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 107 days.

(21) Appl. No.: 13/408,795

(22) Filed: Feb. 29, 2012

(65) Prior Publication Data

US 2012/0224364 A1 Sep. 6, 2012

(30) Foreign Application Priority Data

Mar. 1, 2011 (JP) ..... 2011-043515

(51) Int. Cl.
*F21V 9/00* (2006.01)
*F21V 14/00* (2006.01)

(52) U.S. Cl.
CPC ..... *F21V 14/003* (2013.01)

(58) Field of Classification Search
USPC ..... 362/231, 234–235, 249.02, 237, 362/291–292, 332, 147, 373
See application file for complete search history.

(56) References Cited

U.S. PATENT DOCUMENTS 5,951,145 A * 9/1999 Iwasaki et al. ..... 362/216
8,047,679 B2 * 11/2011 Wu et al. ..... 362/249.02
8,235,547 B2 * 8/2012 Hofmann ..... 362/235
2003/0072156 A1 * 4/2003 Pohlert et al. ..... 362/244
2008/0049427 A1 * 2/2008 Oh ..... 362/267
2011/0188241 A1 * 8/2011 Walczak et al. ..... 362/235
2012/0113640 A1 * 5/2012 Markle et al. ..... 362/249.02

FOREIGN PATENT DOCUMENTS

JP 2008-300203 12/2008

* cited by examiner

*Primary Examiner* — William Carter
*Assistant Examiner* — Kenny C Sokolowski
(74) *Attorney, Agent, or Firm* — Hamre, Schumann, Mueller & Larson, P.C.

(57) ABSTRACT

A Light Emitting Diode (LED) illumination device having a pleasant appearance and capable of uniform illumination is provided. The LED illumination device (101) includes a support portion (200) having a first support surface (210) and a second support surface (220), wherein the first support surface (210) faces downward, and the second support surface (220) faces downward, is located at a position higher than the first support surface (210), and surrounds the first support surface (210); a plurality of LED chips (400), including a plurality of first LED chips (411) supported on the first support surface (210) and a plurality of second LED chips (420) supported on the second support surface (220); and a mask (700), located at a lower position with respect to the support portion (200), penetrated by light from the LED chips (400), and including a tilted portion (710) inclining downward toward the center.

25 Claims, 6 Drawing Sheets

LED ILLUMINATION DEVICE

BACKGROUND OF THE INVENTION

1. Field of the Invention

The present invention relates to a Light Emitting Diode (LED) illumination device including an LED chip.

2. Description of the Related Art

An LED illumination device including an LED chip is a common alternative to illumination devices mounted, for example, with a fluorescent lamp. A ceiling-mounted illumination device is generally known as a ceiling light.

FIG. 7 shows an example of a conventional LED illumination device used as a ceiling light (for example, see Patent Document 1). The LED illumination device 900 shown in FIG. 7 is generally thin-disc shaped and mounted for use on a ceiling 800. The LED illumination device 900 includes a plurality of light source portions 910, a reflective surface 920, and a mask 930. The light source portions 910 are respectively disposed with an LED chip therein (not shown), and configured as a circle. The reflective surface 920 is, for example, a surface of a metal plate member to which a white coating is applied. Light from the light source portion 910 is reflected by the reflective surface 920, and travels downward. The mask 930 includes, for example, resin for diffusing the light and allowing the light to penetrate, so that the light reflected by the reflective surface 920 is diffused and penetrates downward. The LED illumination device 900 is intended to achieve a pleasant appearance suitable for the ceiling 800 and provide uniform illumination indoors.

However, the thinner the profile of the LED illumination device 900 is, the more restrictive the range of possible shapes are that can be adopted for the reflective surface 920. This limitation may adversely affect the uniformity of illumination of the LED illumination device 900.

DOCUMENTS IN THE PRIOR ART

[Patent Document]

[Patent Document 1] Japanese Patent Publication No. 2008-300203

SUMMARY OF THE INVENTION

Problems to be Solved in the Present Invention

In view of the above, the present invention is directed to an LED illumination device having a pleasant appearance and capable of providing uniform illumination.

Technical Means for Solving the Problems

The LED illumination device provided in the present invention includes: a support portion having a first support surface and a second support surface, where the first support surface faces a side, that is, an illumination side, of a first direction, and the second support surface faces the illumination side of the first direction, is located at a position closer to another side, that is, a disposition side, of the first direction than the first support surface, and surrounds the first support surface in a second direction and a third direction perpendicular to the first direction and the second direction and the third direction are perpendicular to each other; a plurality of LED chips, including a plurality of first LED chips supported on the first support surface and a plurality of second LED chips supported on the second support surface; and a mask, located at the illumination side of the first direction with respect to the support portion, penetrated by light from the LED chips, and including a tilted portion that is closer to the illumination side of the first direction with the inclination to a center in the second and third directions.

In a preferred embodiment of the present invention, an outer edge of the first support surface has a round shape as viewed from the first direction.

In a preferred embodiment of the present invention, an outer edge of the first support surface has a rectangular shape or a combination shape having rectangle and arc as viewed from the first direction.

In a preferred embodiment of the present invention, an outer to edge of the first support surface has a polygonal shape or a combination shape having polygon and arc as viewed from the first direction.

In a preferred embodiment of the present invention, the second support surface has an annular shape as viewed from the first direction.

In a preferred embodiment of the present invention, the mask diffuses the light from the LED chips and is penetrated by the light.

In a preferred embodiment of the present invention, the LED illumination device includes a plurality of LED modules, each LED module includes the LED chip and sealing resin, covering the LED chip, and the sealing resin is mixed with a fluorescent material for emitting light having a wavelength different from that of the light from the LED chip when excited by the light from the LED chip.

In a preferred embodiment of the present invention, the LED modules includes a plurality of first color LED modules and a plurality of second color LED modules that emit light of different color temperature.

In a preferred embodiment of the present invention, the light emitted from the first color LED module has a bulb color, and the light emitted from the second color LED module has a daylight color.

In a preferred embodiment of the present invention, the LED illumination device includes at least one first LED substrate, supported on the first support surface, and respectively carrying the LED modules disposed with the first LED chips therein.

In a preferred embodiment of the present invention, the LED illumination device includes a plurality of the first LED substrates, respectively disposed to have a partial annular shape, and configured end to end to form an overall annular shape.

In a preferred embodiment of the present invention, the LED modules carried on the first LED substrates include the first color LED modules and second color LED modules, and the first color LED modules and the second color LED modules are arranged alternately along a circular direction of the first LED substrates.

In a preferred embodiment of the present invention, the LED modules carried on the first LED substrates have a long rectangular shape, and have a length direction along a radial direction of the first LED substrate.

In a preferred embodiment of the present invention, the LED illumination device includes at least one second LED substrate, supported on the second support surface, and respectively carrying the LED modules disposed with the second LED chips therein.

In a preferred embodiment of the present invention, the LED illumination device includes a plurality of the second LED substrates, respectively disposed to have a partial annular shape, and configured end to end to form an overall annular shape.

In a preferred embodiment of the present invention, the LED modules carried on the second LED substrates include the first color LED modules and second color LED modules, and the first color LED modules and the second color LED modules are arranged alternately along a circular direction of the second LED substrates.

In a preferred embodiment of the present invention, the LED modules carried on the second LED substrates have a long rectangular shape, and have a length direction along a radial direction of the second LED substrate.

In a preferred embodiment of the present invention, the first support surface has an annular shape; the support portion includes a third support surface facing the illumination side of the first direction and surrounded by the first support surface in the second direction and the third direction; and the LED chips include a plurality of third LED chips supported on the third support surface.

In a preferred embodiment of the present invention, the third support surface is located at a position closer to the illumination side of the first direction than the first support surface.

In a preferred embodiment of the present invention, the LED illumination device includes a receiving portion, supported on the third support surface, and receiving a signal for controlling an on state of the LED chips.

In a preferred embodiment of the present invention, the third LED chips are configured in an annular shape, and the receiving portion is surrounded by the LED chips.

In a preferred embodiment of the present invention, the LED modules include a plurality of third LED modules respectively disposed with the third LED chips therein and emitting light of a bulb color.

In a preferred embodiment of the present invention, the mask includes a round central portion covering the third support surface.

In a preferred embodiment of the present invention, the mask includes an outer frame portion, located at a position closer to an outer side than the tilted portion in the second direction and the third direction, and having a surface coplanar with the tilted portion and facing the illumination side of the first direction.

In a preferred embodiment of the present invention, the LED illumination device includes a power source portion, supplying power to turn on the LED chips, and located at the disposition side of the first direction with respect to the first support surface.

According to such a structure, the LED chips are supported by the first support surface and the second support surface that are disposed at various heights with respect to one another, so as to prevent any one of the LED chips being extremely close to or distant from the tilted portion of the mask. In this way, the LED illumination device can be disposed in a shape pleasant to look at that slowly bulges from the ceiling and provide uniform indoor illumination.

Other features and advantages of the present invention become clear from the detailed description made with reference to the accompanying drawings.

PREFERRED EMBODIMENT OF THE INVENTION

Figure 1:
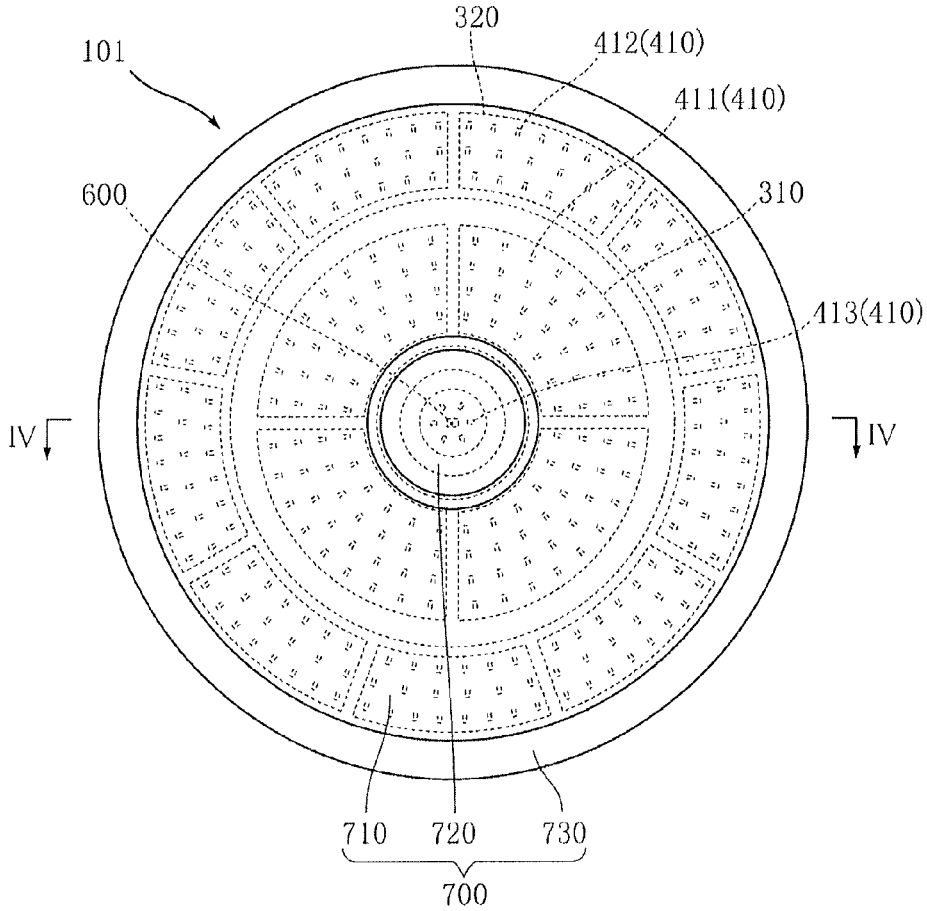
FIG. 1 is a plane view of an LED illumination device according to an embodiment of the present invention.
Figure 2:
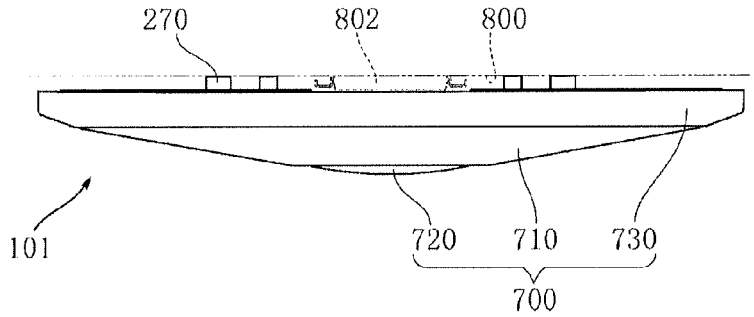
FIG. 2 is a side view of the LED illumination device shown in FIG. 1.
Figure 3:
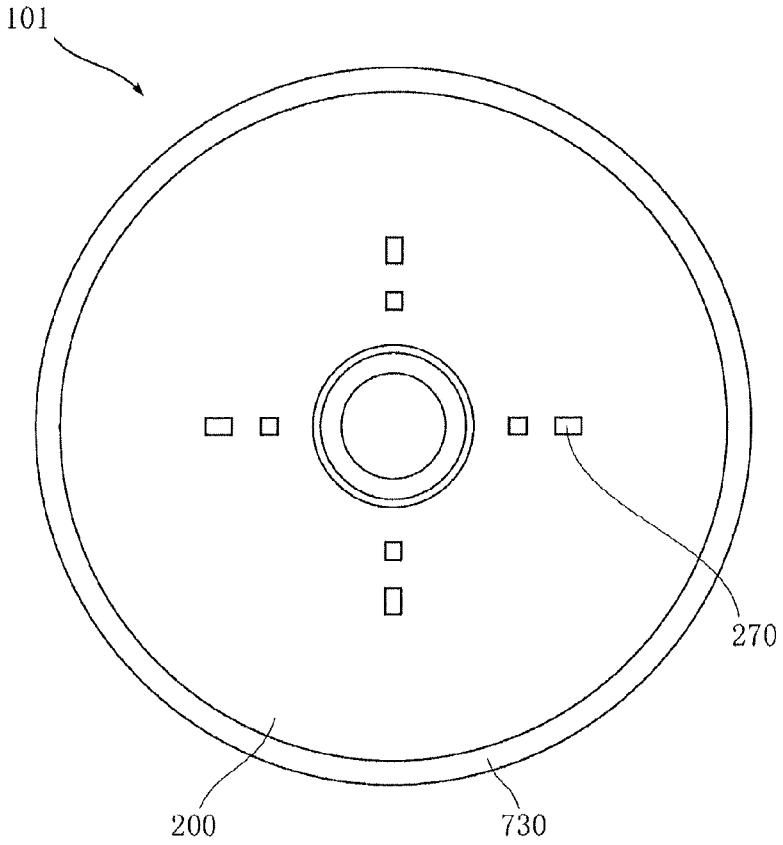
FIG. 3 is a bottom view of the LED illumination device shown in FIG. 1.

Hereinafter, preferred embodiments of the present invention are specifically described with reference to the accompanying drawings.

FIGS. 1 to 5A show an LED illumination device according to an embodiment of the present invention. An LED illumination device 101 of this embodiment includes a support portion 200, a plurality of first LED substrates 310, a plurality of second LED substrates 320, a third LED substrate 330, a plurality of LED modules 400, a power source portion 500, a receiving portion 600, and a mask 700. The LED illumination device 101 is, for example, mounted on a power supply portion 810 on a ceiling 800 by disposing a part 802, so as to be used as a ceiling light. In addition, in FIG. 5A, a majority of a mask 700 is omitted for ease of understanding.

Figure 4:
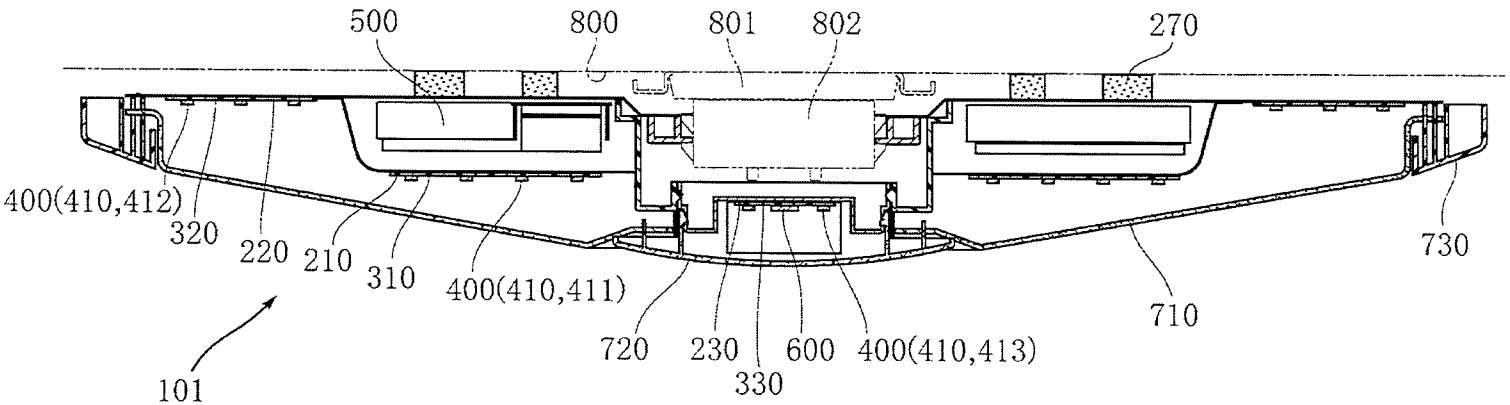
FIG. 4 is a cross-sectional view along a line IV-IV of FIG. 1.
Figure 5A:
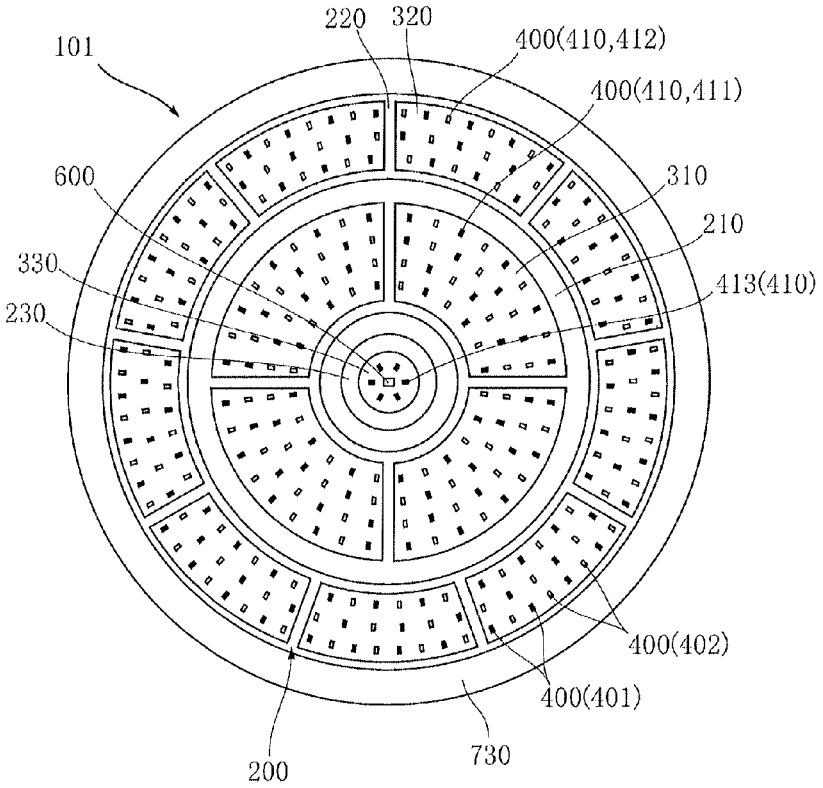
FIG. 5A is a plane view of the LED illumination device of FIG. 1 without a mask.

The support portion 200 includes, for example, a metal plate, which is a base of the LED illumination device 101. The support portion 200 includes a first support surface 210, a second support surface 220, and a third support surface 230. The first support surface 210 has an annular shape with, for example, an outer diameter of about 160 mm. The second support surface 220 surrounds the first support surface 210 as shown in FIG. 5A, and is located at an upper side (a disposition side of a first direction in the present invention) that is closer to the ceiling 800 than the first support surface 210 as shown in FIG. 4. The second support surface 220 has an annular shape with, for example, an outer diameter of about 250 mm. The distance between the first support surface 210 and the second support surface 220 is, for example, about 30 mm in FIG. 5A. The third support surface 230 is surrounded by the first support surface 210, and has a round shape with, for example, an outer diameter of about 60 mm. The third support surface 230 is closer to a lower side than the first support surface 210 in FIG. 4. A plurality of buffer materials 270 are disposed on a surface of the support portion 200 facing the ceiling 800.

The first LED substrates 310, the second LED substrates 320, and the third LED substrate 330 are, for example, insulating substrates including glass epoxy resin, and respectively carry the LED modules 400. The first LED substrates 310 are mounted on the first support surface 210 and each has a partial annular shape. In this embodiment, four first LED substrates 310 are configured end to end to form an overall annular shape. The second LED substrates 320 are mounted on the second support surface 220, and each has a partial annular shape. In this embodiment, nine second LED substrates 320 are configured end to end to form an overall annular shape. The third LED substrate 330 is mounted on the third support surface 230, and has a round shape.

Figure 6:
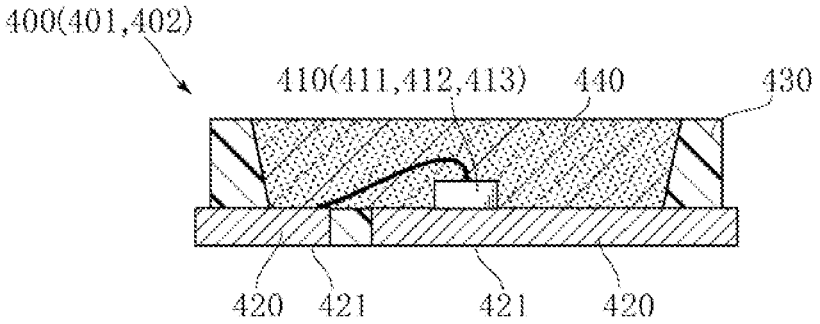
FIG. 6 is a cross-sectional view of an LED module used in the LED illumination device shown in FIG. 1 according to an embodiment of the present invention.
Figure 7:
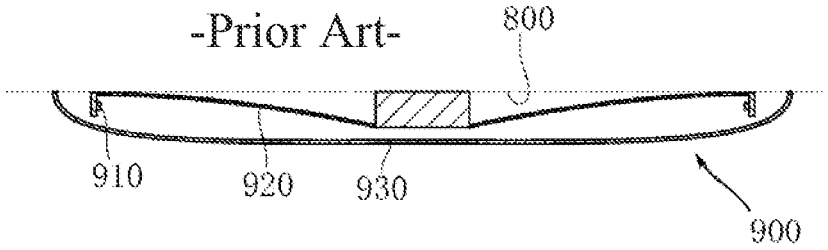
FIG. 7 is a cross-sectional view of a conventional LED illumination device.

The LED modules 400 are mounted on the first LED substrates 310, the second LED substrates 320, and the third LED substrate 330. Each of the LED modules 400 is disposed in a long rectangular shape as viewed from above. FIG. 6 is a cross-sectional view of a plane that is perpendicular to a short side direction of the LED module 400. As shown in FIG. 6, the LED module 400 includes a pair of leads 420, an LED chip 410, sealing resin 440, and a casing 430. The pair of leads 420 include, for example, Cu alloy, and one of the leads carries the LED chip 410. A surface of the lead 420 at a side opposite to that carries the LED chip 410 is disposed as a mounting terminal 421 for surface mounting of the LED module 400. The LED chip 410 is a light source of the LED module 400, and can emit, for example, blue light. The sealing resin 440 is used for protecting the LED chip 410. The sealing resin 440 is formed by transmissive resin including a fluorescent material, and the fluorescent material emits yellow light when excited by the light from the LED chip 410. Therefore, color temperature of the limit emitted from the LED module 400 can be appropriately determined. For the fluorescent material, materials emitting red light and green light can be used in combination to replace the material emitting yellow light. The casing 430 includes, for example, white resin, and is used for reflecting upward light emitted from the LED chip 410 to a side direction. In addition, the LED chip 410 can also be a twin-wire type chip connected to the pair of leads 420 through two wires.

In this embodiment, the LED modules 400 are divided into bulb color LED modules 401 emitting light of a bulb color and daylight color LED modules 402 emitting light of a daylight color. In FIG. 5A, the bulb color LED modules 401 are painted black for ease of understanding.

In the present invention, in the LED chip 410, the LED chips disposed in the LED modules 400 supported on the first support surface 210 are defined as first LED chips 411, the LED chips disposed in the LED modules 400 supported on the second support surface 220 are defined as second LED chips 412, and the LED chips disposed in the LED modules 400 supported on the third support surface 230 are defined as third LED chips 413.

In this embodiment, the LED modules 400 disposed with the first LED chips 411 therein are supported on the first support surface 210 by the first LED substrates 310, and are configured in a manner such that four layers of an annular shape are formed. Among the LED modules 400 forming the annular shape, the bulb color LED modules 401 and the daylight color LED modules 402 are arranged alternately. The LED modules 400 disposed with the second LED chips 412 therein are supported on the second support surface 220 by the second LED substrates 320, and are configured in a manner such that three layers of an annular shape are formed. Among the LED modules 400 forming the annular shape, the bulb color LED modules 401 and the daylight color LED modules 402 are arranged alternately. The LED modules 400 disposed with the third LED chips 413 therein are supported on the third support surface 230 by the third LED substrate 330, and are configured in a manner such that an annular shape is formed. The LED modules 400 are all bulb color LED modules 401.

The power source portion 500 is used for converting, for example, an alternating-current power of 100 V supplied from the power supply portion 801 on the ceiling 800 into a direct-current power at a voltage suitable to turn on the LED chips 410, and supplying the power to the LED modules 400. The power source portion 500 includes, for example, a transformer, a condenser, a resistor, a diode, and an Integrated Circuit (IC). Moreover, the power source portion 500 can independently control the brightness of the bulb color LED modules 401 and the daylight color LED modules 402. In this way, the LED illumination device 101 can optionally radiate light having a color temperature from bulb color to daylight color. In addition, the power source portion 500 can merely turn on and off the LED modules 400 disposed with the third LED chips therein independent of the other LED modules 400. In this embodiment, as shown in FIG. 4, the power source portion 500 is accommodated in a space at the upper side in FIG. 4 relative to the first support surface 210.

The receiving portion 600 is used for receiving a signal transmitted from an external transmitter, and is supported on the third support surface 230 by the third LED substrate 330 in this embodiment. On the third LED substrate 330, the receiving portion 600 is configured at a position surrounded by the LED modules 400. The signal received by the receiving portion 600 is transferred to the power source portion 500. The power source portion 500 controls the on state of the LED modules 400 according to the instruction of the signal.

The mask 700 almost forms the whole appearance of the LED illumination device 101, and includes a tilted portion 710, a central portion 720, and an outer frame portion 730. The tilted portion 710 includes, for example, cream white translucent resin, which covers the first support surface 210 and the second support surface 220. As shown in FIG. 4, the tilted portion 710 inclines downward toward the center. The central portion 720 includes, for example, cream white translucent resin, which covers the third support surface 230. As shown in FIG. 1, the outer frame 730 surrounds the tilted portion 710, and is disposed in an annular shape. As shown in FIG. 4, the outer frame portion 730 has a surface coplanar with a lower surface of the tilted portion 710.

Subsequently, the function of the LED illumination device 101 is described.

According to this embodiment, the LED modules 400 are supported by the first support surface 210 and the second support surface 220 that are disposed at various heights with respect to one another, so as to prevent any one of the LED modules 400 being extremely close to or distant from the tilted portion 710 of the mask 700. In this way, the LED illumination device 101 can be disposed in a shape pleasant to look at that slowly bulges from the ceiling 800, and the LED illumination device 101 can provide uniform indoor illumination. The LED illumination device 101 is more pleasant to look at with the outer frame portion 730.

As bulb color LED modules 401 and the daylight color LED modules 402 are both included, light emitted from the LED illumination device 101 achieves a random color temperature from bulb color to daylight color. The adjustment of color temperature or the turning on or off can be properly conducted at a position away from the LED illumination device 101 through the receiving portion 600. Unnecessary space in the LED illumination device 101 can be eliminated through the configuration of the power source portion 500 at an upper side of the first support surface 210.

Uniform illumination can be achieved through the configuration of the LED modules 400 in an annular shape. The LED modules 400 can be easily configured in an annular shape through the annular disposition of the first LED substrates 310 and the second LED substrates 320. Light of a color temperature equivalent to an intermediate color between the bulb color and the daylight color can be uniformly radiated by, for example, alternately arranging the bulb color LED modules 401 and the daylight color LED modules 402.

Figure 5B:
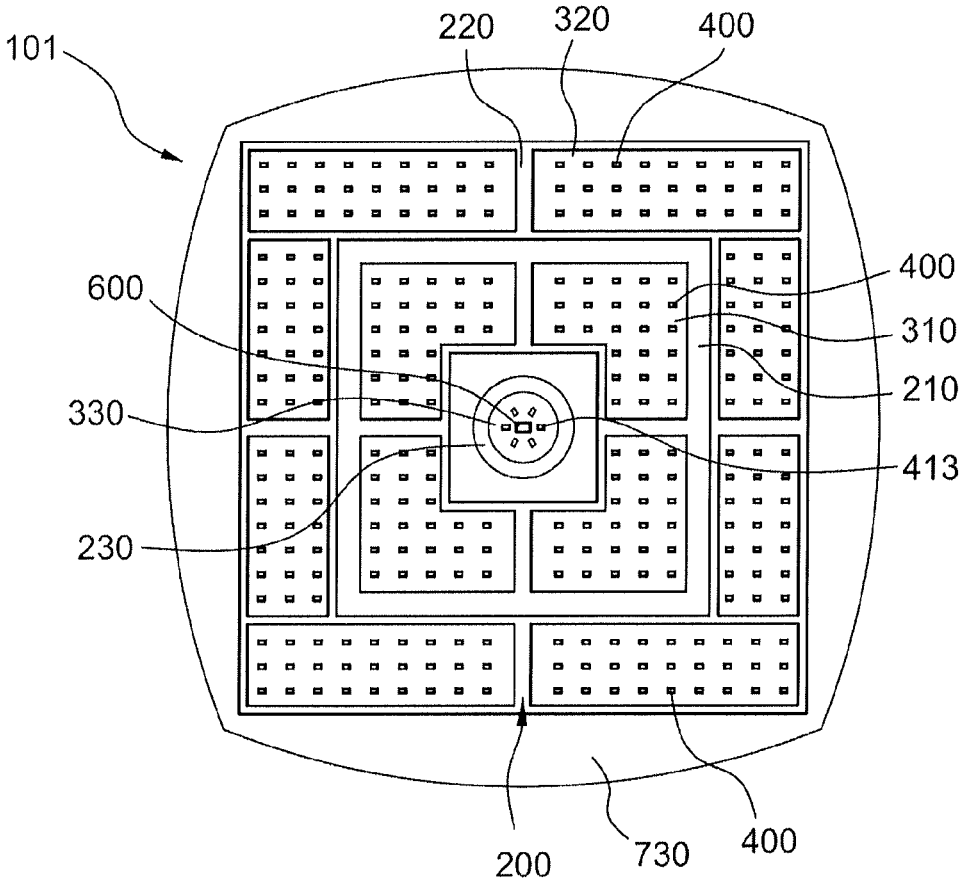
FIG. 5B is a plane view of the LED illumination device according to a variation example of FIG. 5A.
Figure 5C:
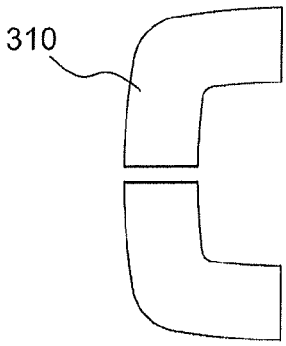
FIG. 5C shows another variation example of a first LED substrate in FIG. 5B.

In a variation example, referring to FIGS. 5B and 5C, the first support surface 210 and a place carrying the first LED substrate 310 can be a rectangular shape or a combination shape having rectangle and arc, and can be the rectangular or the combination shape having three layers LEDs carried on the first LED substrate 310. The second support surface 220 and the second LED substrate 320 have the same shape. Additionally, the LED illumination device 101 has a rectangular shape or a combination shape having rectangle and arc as viewed from the plane. The other configuration of the LED illumination device 101 is the same as that shown in FIG. 5A.

Furthermore, in the other variation example, the first support surface 210, the second support surface 220, the first LED substrate 310 and the second LED substrate 320 can be a polygonal shape or a combination shape having polygon and arc.

According to the variation example, when the substrate is the rectangular shape or the combination shape having rectangle and arc, the power source substrate carried on the rear of the first support surface 210 can use a rectangular substrate. Because the number of the substrate and the space arranging the power source substrate can be utilized efficiently, it can facilitate the miniaturized power source and the manufacture of the power source substrate.

While the invention has been described and illustrated with reference to specific embodiments thereof, these descriptions and illustrations do not limit the invention. It should be understood by those skilled in the art that various changes may be made and equivalents may be substituted without departing from the true spirit and scope of the invention as defined by the appended claims. All such modifications are intended to be within the scope of the claims appended hereto.

What is claimed is:

1. A Light Emitting Diode (LED) illumination device, comprising:

a support portion, comprising: a first support surface; a second support surface; and a third support surface, wherein the first support surface faces a side, that is, an illumination side, of a first direction, and the second support surface faces the illumination side of the first direction, is located at a position closer to another side, that is, a disposition side, of the first direction than the first support surface, and surrounds the first support surface in a second direction and a third direction perpendicular to the first direction, and the second direction and the third direction are perpendicular to each other, and the third support surface faces the illumination side of the first direction, is located at a position closer to the illumination side of the first direction than the first support surface, and surrounded by the first support surface in the second direction and the third direction;

a plurality of LED chips, comprising a plurality of first LED chips supported on the first support surface, a plurality of second LED chips supported on the second support surface, and a plurality of third LED chips supported on the third support surface; and a mask, located at the illumination side of the first direction with respect to the support portion, penetrated by light from the LED chips, and comprising a tilted portion and a central portion, the tilted portion being closer to the illumination side of the first direction with the inclination to a center in the second direction and third direction, and the central portion being surrounded by the tilted portion, having a flat surface parallel to the second direction and the third direction, and being formed on the third LED chips, wherein the first support surface, the second support surface, and the third support surface are disposed unevenly so as to follow a height profile of the mask with respect to the illumination side along the first direction.

2. The LED illumination device according to claim 1, wherein an outer edge of the first support surface has a round shape as viewed from the first direction.

3. The LED illumination device according to claim 2, wherein the second support surface has an annular shape as viewed from the first direction.

4. The LED illumination device according to claim 1, wherein an outer edge of the first support surface has a rectangular shape or a combination shape having rectangle and arc as viewed from the first direction.

5. The LED illumination device according to claim 1, wherein an outer edge of the first support surface has a polygonal shape or a combination shape having polygon and arc as viewed from the first direction.

6. The LED illumination device according to claim 1, wherein the mask diffuses the light from the LED chips and is penetrated by the light.

7. The LED illumination device according to claim 1, further comprising a plurality of LED modules, each comprising the LED chip and sealing resin, covering the LED chip, wherein the sealing resin is mixed with a fluorescent material for emitting light having a wavelength different from that of the light from the LED chip when excited by the light from the LED chip.

8. The LED illumination device according to claim 7, wherein the LED modules comprises a plurality of first color LED modules and a plurality of second color LED modules that emit light of different color temperature.

9. The LED illumination device according to claim 8, wherein the light emitted from the first color LED module has a color temperature different from a color temperature generated from the second color LED module, and the light emitted from the second color LED module has a daylight color.

10. The LED illumination device according to claim 8, further comprising at least one first LED substrate, supported on the first support surface, and respectively carrying the LED modules disposed with the first LED chips therein.

11. The LED illumination device according to claim 10, further comprising a plurality of the first LED substrates, respectively disposed to have a partial annular shape, and configured end to end to form an overall annular shape.

12. The LED illumination device according to claim 11, wherein the LED modules carried on the first LED substrates comprise the first color LED modules and second color LED modules, and the first color LED modules and the second color LED modules are arranged alternately along a circular direction of the first LED substrates.

13. The LED illumination device according to claim 12, wherein the LED modules carried on the first LED substrates have a long rectangular shape, and have a length direction along a radial direction of the first LED substrate.

14. The LED illumination device according to claim 8, further comprising at least one second LED substrate, supported on the second support surface, and respectively carrying the LED modules disposed with the second LED chips therein.

15. The LED illumination device according to claim 14, further comprising a plurality of the second LED substrates, respectively disposed to have a partial annular shape, and configured end to end to form an overall annular shape.

16. The LED illumination device according to claim 15, wherein the LED modules carried on the second LED substrates comprise the first color LED modules and second color LED modules, and the first color LED modules and the second color LED modules are arranged alternately along a circular direction of the second LED substrates.

17. The LED illumination device according to claim 16, wherein the LED modules carried on the second LED substrates have a long rectangular shape, and have a length direction along a radial direction of the second LED substrate.

18. The LED illumination device according to claim 1, wherein the first support surface has an annular shape.

19. The LED illumination device according to claim 18, wherein the third support surface is located at a position closer to the illumination side of the first direction than the first support surface.

20. The LED illumination device according to claim 18, further comprising a receiving portion, supported on the third support surface, and receiving a signal for controlling an on state of the LED chips.

21. The LED illumination device according to claim 20, wherein the third LED chips are configured in an annular shape, and the receiving portion is surrounded by the LED chips.

22. The LED illumination device according to claim 18, wherein the LED modules comprise a plurality of third LED modules respectively disposed with the third LED chips therein and generating a color temperature different from a color temperature generated from the second color LED module.

23. The LED illumination device according to claim 18, wherein the central portion is round and configured to cover the third support surface.

24. The LED illumination device according to claim 1, wherein the mask comprises an outer frame portion, located at a position closer to an outer side than the tilted portion in the second direction and the third direction, and having a surface coplanar with the tilted portion and facing the illumination side of the first direction.

25. The LED illumination device according to claim 1, further comprising a power source portion, supplying power to turn on the LED chips, and located at the disposition side of the first direction with respect to the first support surface.

* * * * *